United States Patent [19]

Wesson et al.

[11] Patent Number: 4,905,759

[45] Date of Patent: Mar. 6, 1990

[54] COLLAPSIBLE GUN ASSEMBLY

[75] Inventors: David S. Wesson, Katy; Kevin R. George, Columbus, both of Tex.; David M. Haugen, Sierra Madre, Calif.

[73] Assignee: Halliburton Company, Duncan, Okla.

[21] Appl. No.: 173,598

[22] Filed: Mar. 25, 1988

[51] Int. Cl.[4] ..... E21B 43/117

[52] U.S. Cl. ..... 166/55; 166/55.1; 166/117; 166/297; 166/377

[58] Field of Search ..... 166/55.1, 55, 297, 377, 166/376, 383, 117

[56] References Cited

U.S. PATENT DOCUMENTS

| | | | |
|---|---|---|---|
| 2,157,729 | 5/1939 | Church | 166/55.1 X |
| 2,876,843 | 3/1959 | Huber | 166/55 |
| 2,927,534 | 3/1960 | Le Bus | 102/20 |
| 3,003,558 | 10/1961 | Orr | 166/43 |
| 3,189,094 | 6/1965 | Hyde | 166/55.1 X |
| 3,447,607 | 6/1969 | Harris et al. | 166/297 X |
| 4,040,482 | 8/1977 | Vann | 166/297 X |
| 4,113,016 | 9/1978 | Trott | 166/297 |
| 4,164,886 | 8/1979 | Hallmark | 89/1 |
| 4,515,217 | 5/1985 | Stout | 166/297 |
| 4,526,233 | 7/1985 | Stout | 166/377 |
| 4,612,992 | 9/1986 | Vann et al. | 166/297 |
| 4,619,333 | 10/1986 | George | 166/297 X |
| 4,650,010 | 3/1987 | George et al. | 175/4.52 |
| 4,771,827 | 9/1988 | Barker et al. | 166/377 X |
| 4,776,393 | 10/1988 | Forehand et al. | 166/377 X |
| 4,790,383 | 12/1988 | Savage et al. | 166/297 |

FOREIGN PATENT DOCUMENTS 2177740 1/1987 United Kingdom .

*Primary Examiner*—Hoang C. Dang

*Attorney, Agent, or Firm*—Arnold, White & Durkee

[57] ABSTRACT

The described invention includes an apparatus for perforating a well through use of one or more perforating guns in a collapsible perforating assembly. The collapsible perforating assembly includes a collapsible spacer mandrel which may be placed between two or more perforating guns. The spacer mandrel will be adapted to keep the guns in a desired spaced relationship prior to actuation of the guns. After actuation, the gun spacer assembly will be allowed to telescopically collapse in length. When the perforating assembly is then released from the tubing string and dropped to the bottom of the well, the assembly will collapse, decreasing the amount of rat hole necessary to accommodate the perforating assembly.

8 Claims, 3 Drawing Sheets

COLLAPSIBLE GUN ASSEMBLY

BACKGROUND OF THE INVENTION

The present invention relates generally to methods and apparatus for perforating a well, and more specifically relates to collapsible perforating assemblies for use in perforating a well.

After a well is drilled and the casing is set, the well is often perforated through use of tubing conveyed perforating equipment. In a tubing conveyed perforating operation, the perforating guns are carried on the tubing string, and are typically actuated either by dropping detonating bars down the tubing, or by applying hydraulic pressure proximate the gun firing head, to actuate the firing head. In order to produce the well after perforation, it is often desirable to drop the gun assembly into the wellbore. The gun assembly is dropped off into the "rat hole," i.e., that area of the wellbore below the production zone.

In many cases multiple perforating guns will be utilized in a perforating assembly with the perforating guns spaced at desired intervals. The spacing of the perforating guns allows the guns to be utilized to perforate different zones on a single trip, to perforate different horizons of a single zone, or to avoid perforating a weak section of casing. Such perforating assemblies with spaced guns may extend a considerable length, for example thirty to sixty feet, or longer. Where the guns are to be dropped from the tubing after detonation, the rat hole must be able to accommodate this length. If the rat hole does not extend far enough below the production zone, conventional perforating assemblies may not be able to be dropped off.

Accordingly, the present invention provides a new perforating assembly which is adapted to space perforating guns a desired distance apart prior to their detonation, and to be telescopically collapsed after gun actuation so that when dropped off, a relatively short rat hole will be able to accommodate the gun assembly. Accordingly this collapsible perforating assembly facilitates the use of long, spaced, intervals of tubing conveyed perforating guns, and the dropping of the assembly, even when the well rat hole is shorter the original length of the perforating assembly.

SUMMARY OF THE INVENTION

A telescopically collapsible perforating assembly is described. In a preferred embodiment, the perforating assembly has a collapsible gun spacer including two spacer tubes. The spacer tubes are adapted to be telescopically collapsed one within the other. A locking device is provided to lock the spacer tubes in an uncollapsed position until after the perforating guns are detonated. After detonation, the locking mechanism releases the spacer tubes which, when the assembly is dropped, telescopically collapse, decreasing the length of the gun assembly.

In one embodiment of the invention, the locking mechanism is a mechanical device which includes a plurality of lugs which prevent relative vertical movement one of the spacer tubes. The locking mechanism releases the spacer tubes by means of a pressure differential established by fluid in the perforating assembly. In another embodiment of the invention, the locking mechanism is a hydraulic device wherein fluid pressure restrains relative movement of the spacer tubes.

BRIEF DESCRIPTION OF THE DRAWINGS

FIG. 1A depicts the assembly prior to actuation of the perforating guns and FIG. 1B depicts the assembly after being dropped to the bottom of the rat hole.

DETAILED DESCRIPTION OF THE PREFERRED EMBODIMENT

Figure 1A:
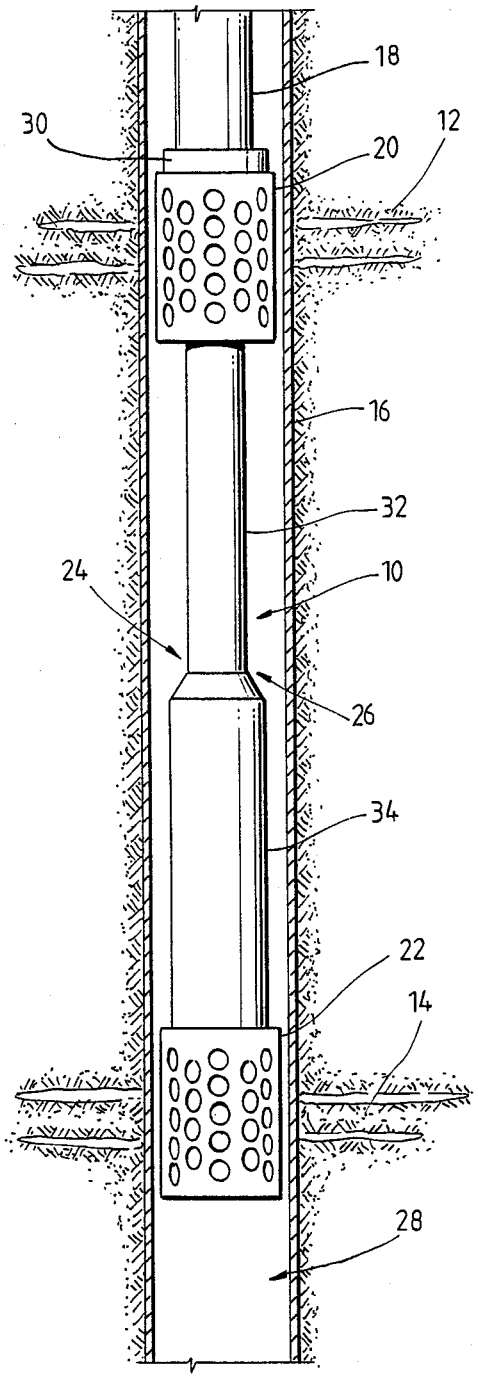
FIGS. 1A–1B depict a collapsible perforating gun assembly in accordance with the present invention, illustrated partially in vertical section.

Referring now to the drawings in more detail, and particularly to FIG. 1A, therein is shown a wellbore 10 which extends from the surface down through production zones 12 and 14, in which casing 16 has been set. A tubing string 18 extends from the surface down through wellbore 10, and supports a perforating assembly, indicateded generally at 26, proximate production zones 12 and 14. Perforating assembly 26 includes perforating guns 20 and 22 which are suspended adjacent production zones 12 and 14, respectively. Perforating guns 20 and 22 may, in actuality, each include one or more perforating guns coupled together. Perforating guns 20 and 22 will each have one or more firing heads (not illustrated) associated with them to facilitate detonation of the perforating guns in a conventional manner. Perforating assembly 26 also includes gun spacer assembly, indicated generally at 24, which separates perforating guns 20 and 22. Preferably, both guns 20 and 22 will be actuated through use of a single firing head coupled to one of the guns. The actuation will preferably be transmitted to the other gun through use of a length of detonating cord 27, such as primacord, extending between the two guns, through gun spacer assembly 24. Perforating assembly 26 is preferably coupled to tubing string 18 by a tubing release mechanism 30. Tubing release 30 may be one of any appropriate type known to the industry.

When the well is desired to be perforated, perforating guns 20 and 22 are detonated and the casing 16 and production zones 12 and 14 are perforated. After the detonation of perforating guns 20 and 22, perforating assembly 26 may be dropped off into rat hole 28 through use of release mechanism 30.

Figure 1B:
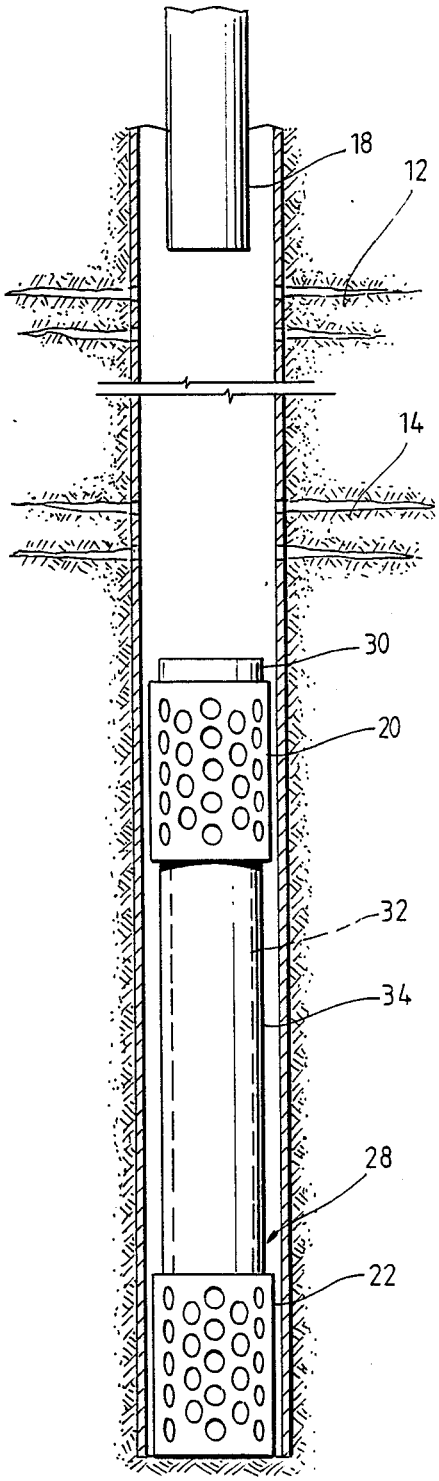

Perforating assembly 26 is adapted to be telescopically collapsible so as to shorten its length when dropped into rat hole 28. Specifically, gun spacer assembly 24 is adapted to collapse in length. Gun spacer assembly 24 includes an upper spacer tube 32 and a lower spacer tube 34 which are in coaxial, telescopically engagable, relation with one another. As shown in FIGS. 1A and 1B, lower spacer tube 34 is preferably placed externally to upper spacer tube 32. As illustrated herein, upper and lower spacer tubes 32 and 34, of gun spacer assembly 24 couple directly to upper and lower perforating guns 20 and 22, respectively. Gun spacer assembly facilitates the use of one of more lengths of tubing (such as tubing joints or pup joints), coupled to gun spacer assembly 24 to space perforating guns 20 and 22 at the desired interval. When such lengths of tubing are to be utilized, the additional lengths will preferably be distributed as equally as possible on each side of perforating gun assembly (i.e., coupled to upper and lower spacer tubes 32 and 34). This maximizes the benefits obtained through use of the present invention.

Figure 2A:
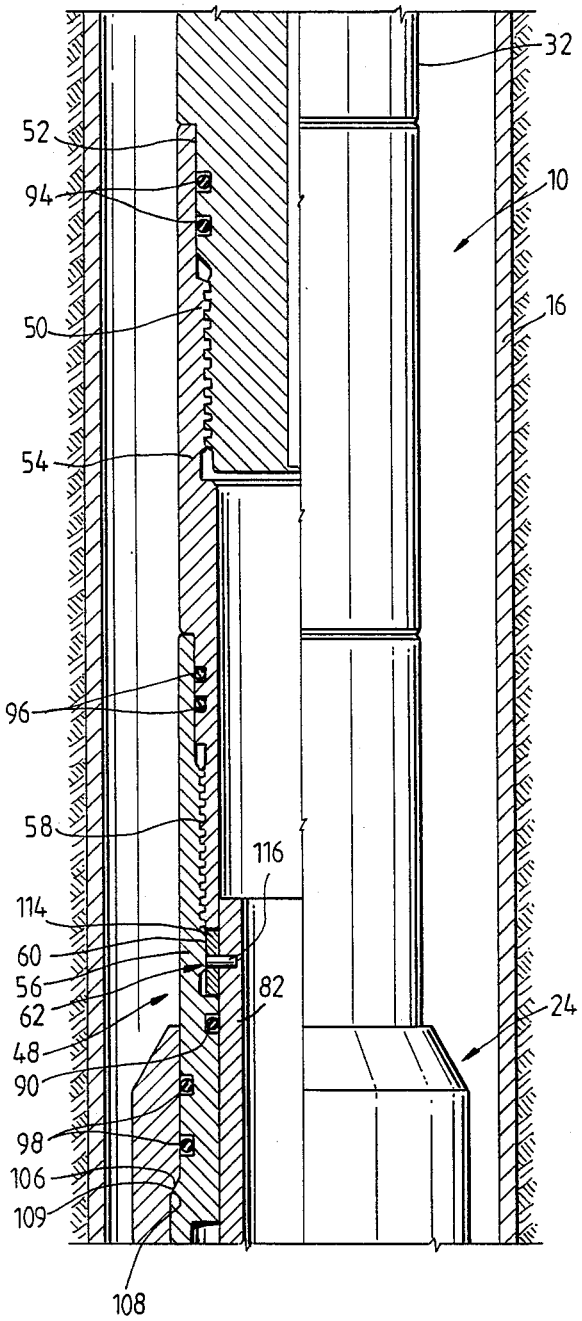
FIG. 2 is a side view, depicted partially in vertical section of a collapsible perforating gun assembly in accordance with the present invention.
Figure 2B:
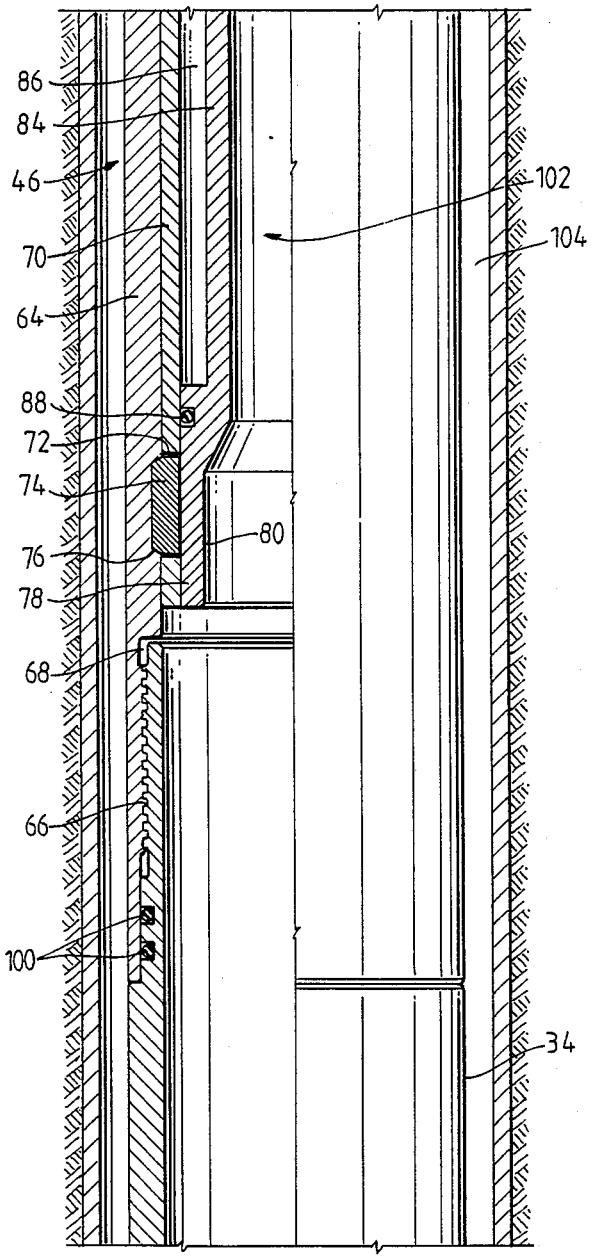

Referring now also to FIGS. 2A and 2B therein is depicted gun spacer assembly 24 in greater detail. As indicated above, gun spacer assembly 24 includes an upper spacer tube 32 and a lower spacer tube 34. Upper spacer tube 32 is coupled at its upper end to an upper perforating gun (20 in FIG. 1A). Similarly, lower spacer tube 34 is coupled at its lower end to lower perforating gun (22 in FIG. 1A). In the embodiment of FIGS. 2A and 2B, lower spacer tube 34 has a 3.375 outside diameter and a 2.625 inch inside diameter, while upper spacer tube 32 has a 2.5 inch gun outer diameter. Because the inside diameter of lower spacer tube 34 is greater than the outside of the diameter of upper spacer tube 32, lower spacer tube 34 will freely slide over upper spacer tube 32 to decrease the total length of gun spacer assembly 24. Tubing lengths coupled to upper or lower spacer tubes 32 and 34 will preferably be of an outer diameter equal to that of the spacer tube to which they are coupled.

A locking mechanism, indicated generally at 46, allows the gun spacer assembly to be releasably locked in a first, uncollapsed (extended), position. Locking mechanism 46 includes a mandrel 48 operatively coupled to upper spacer tube 32 such as by a box/pin connection 50. Mandrel 48 engages an annular recess 52 around upper spacer tube 32. In this manner, the outside diameter of mandrel 48 and the outside diameter of upper spacer tube 32 may be the same.

Mandrel 48 includes an upper member 54, a lower member 56 and a sleeve 64. Upper member 54 and lower member 56 are connected, such as by means of a box/pin connection 58. Lower member 56 includes a circumferential groove 60, on its inside diameter proximate box/pin connection 58, to receive a shear pin assembly 62, as discussed in more detail below.

Sleeve 64 is operatively coupled to lower spacer tube 34 such as by box/pin connection 66. Lower spacer tube 34 engages a circumferential recess 68 on the inside diameter of sleeve 64. In this manner, the inside diameters of the lower spacer tube 34 and the sleeve 64 may be the same. Sleeve 64 extends longitudinally upward from lower spacer tube 34 to slidingly engage the outside of lower member 56 of mandrel 48.

Sleeve 64 preferably includes a radially inwardly extending projection 106 on its inside diameter while lower member 56 of mandrel 148 preferably includes a radially outwardly extending lip 108 on the outside diameter of mandrel 48. Projection 106 and lip 108 cooperatively form a bearing surface 109 to restrict downward movement of sleeve 64 and attached lower spacer tube 34.

Lower member 56 of mandrel 48 includes an annular skirt 70 which extends longitudinally downwardly along the inside diameter of sleeve 64. Skirt 70 includes circumferentially-spaced windows 72 which are adapted to receive lugs 74. In a first position, lugs 74 are also received within an annular groove 76 on the inside diameter of sleeve 64. Lugs 74 are held in this first position (within grooves 76 and windows 72), by a generally cylindrical piston 78. Piston 78 is adapted to slide along the inside diameter of mandrel 48 and skirt 70. Lower portion 80 of piston 78 slidingly engages skirt 70 and serves to retain lugs 74 seated in engagement with windows 72 and groove 76. The described engagement of lugs 74 with both skirt 70 of mandrel 48 and with sleeve 64 serves to secure those members in fixed relation to one another.

Upper portion 82 of piston 78 slidingly engages mandrel 48. Intermediate portion 84 of piston 78 and skirt 70 are cooperatively formed to define an annular chamber 86. Seals 88 and 90 isolate annular chamber 86, and maintain a gas within annular chamber 86 at a predetermined pressure. Preferably, annular chamber 86 will be filled with air at atmospheric pressure.

Seals 94, 96, 98 and 100 serve to isolate interior 102 of gun spacer assembly 24 from the wellbore annulus 104, and to maintain interior 102 of gun spacer assembly 24 at a predetermined pressure, preferably atmospheric pressure, prior to the detonation of the perforating guns. When chamber 86 and interior 102 of gun spacer assembly 24 are both at atmospheric (or the same), pressure, piston 78 is pressure balanced, and, thus, stationary.

When the perforating guns and the gun spacer assembly are being run down the hole prior to perforation, sudden jarring may occur which could result in premature release of the locking mechanism 46. To prevent this premature release, a shear pin assembly 62 is provided. Shear pin assembly 62 includes a shear block 114 disposed in an annular groove 60 located at the junction of lower portion 56 and upper member 54 of mandrel 48. Shear pin 116 extends through shear block 114 and engages a slot 118 in piston sleeve 78. Thus, shear pin 116 holds piston 78 in place relative to mandrel 48 until such time as shear pin 116 shears.

In this preferred embodiment, a pressure differential between annular space 86 and interior 102 of gun assembly 24 will cause the upward movement of piston sleeve 78, which will, in turn, facilitate the collapse of perforating assembly 26. When perforating guns (20 and 22 in FIGS. 1A and 1B) are discharged, fluid in the wellbore annulus 104 is free to flow into the interior of the perforating guns and into interior 102 of gun spacer assembly 24. For example, as discussed in U.S. Pat. No. 4,598,775 to Vann, et al., when a conventional scalloped perforating gun is actuated, shaped charges located on the interior of a perforating gun are detonated, piercing the outer surface of the perforating gun. When this piercing occurs, fluid is allowed to flow into the perforating gun and into the tubing string bore.

Locking mechanism 46 is released by upward vertical movement of piston 78. When piston 78 moves upward, lower portion 80 of piston 78 moves out of engagement with lugs 74. Lugs 74 will then fall radially inward, to a second position wherein they disengage groove 76. Lower spacer tube 42 and sleeve 64 are thus freed to move upward relative to the remainder of mandrel 48 and upper spacer tube 32.

When fluid flows from the wellbore annulus 104 into the interior 102 of gun spacer assembly 24, the fluid pressure on the interior 102 of gun spacer assembly 24 increases relative to the pressure within annular chamber 86. Thus, fluid pressurre on the exterior of piston 78 becomes greater than the fluid pressure in annular chamber 86. When this pressure differential exceeds the shear value of shear pin 116, the pin will shear and the pressure differential will force piston 78 to move vertically upward. As depicted in FIG. 1B, when perforating assembly 26 is released from the tubing string, and allowed to fall to the bottom of the wall, sleeve 64 will move upwardly and perforating assembly will collapse. Where upper and lower spacer tubes are of equal length, gun spacer assembly 24 will collapse to approximately one-half of its original length.

Figure 3:
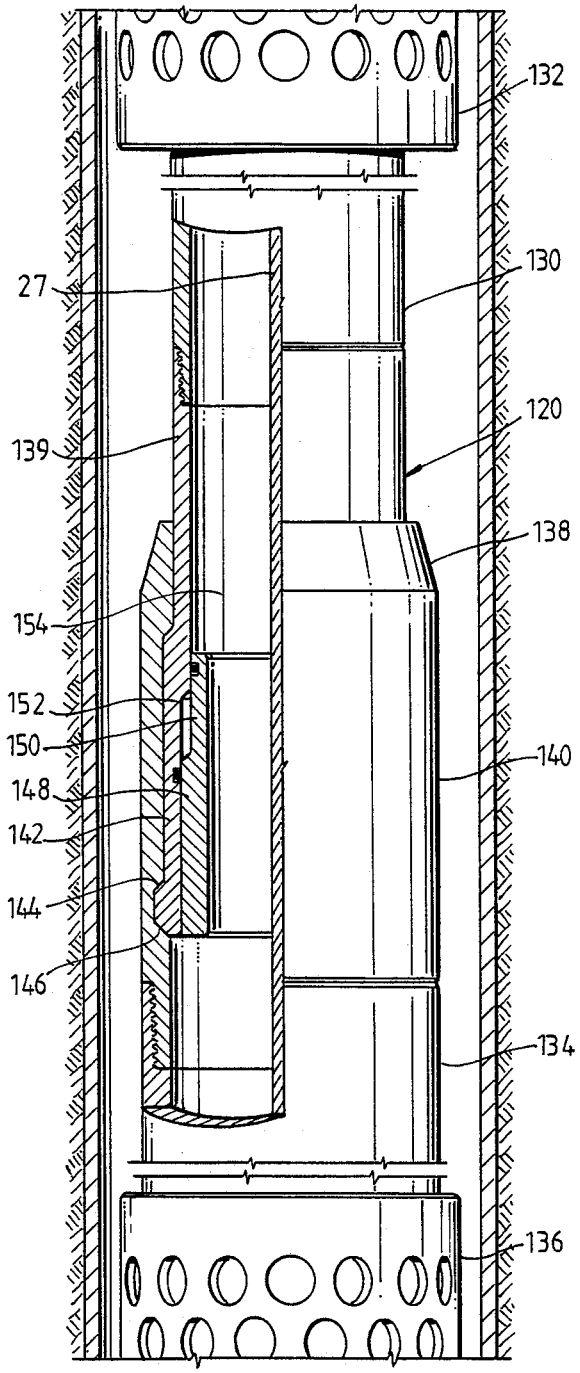
FIG. 3 is a side view, depicted partially in vertical section, of an alternative embodiment of a perforating gun spacer assembly in accordance with the present invention.

Referring now to FIG. 3, shown therein is an alternative embodiment of a collapsible perforating assembly 120 in accordance with the present invention. Perforating assembly 120 is similar to operation to perforating assembly 26 of FIGS. 1A and 1B and FIGS. 2A and 2B. Accordingly only the primary differences will be discussed herein. Perforating assembly 120 differs from perforating assembly 26 primarily in the use of collets, rather than separate lugs, to latch the mandrel in an extended position.

Perforating assembly 120 involves upper and lower spacer tubes 130 and 134, respectively. Upper spacer tube 130 is operatively coupled to an upper perforating gun 132, and lower spacer tube 134 is operatively to lower perforating gun 136. Upper and lower spacer tubes are coupled to complementary portions of a collapsible mandrel 138. Mandrel 138 includes an upper sleeve 139 and a lower sleeve 140. The sleeves 139 and 140 of collapsible mandrel 138 are retained in a first, unactuated, position by a collet latching mechanism. Lower sleeve 140 includes a plurality of peripherally-spaced collet fingers 142 extending at its lower extreme. Collet fingers 142 each include a projection 144 extending radially outward. Projections 144 are adapted to engage an annular groove 146 on the inside circumference of sleeve 140. A piston 148 slidingly engages the interior circumference of mandrel 138 (including collet fingers 142), to hold collet fingers 142 in engagement with groove 146 of sleeve 140. Piston 148 is radially inwardly spaced at an intermediate portion 150 from mandrel 138, forming an annular chamber 152.

When gun spacer assembly 128 is in an unactuated position, piston 148 is pressure balanced, i.e., the pressure within annular chamber 152 is equal to the pressure within the interior 154 of gun spacer assembly 128. When perforating guns 132 and 136 are detonated, the fluid from the wellbore annulus is again allowed to enter the interior 154 of gun spacer assembly 128. When this occurs, the fluid pressure across piston 148 becomes unbalanced, forcing piston 148 upward. When piston 148 moves upward, collet fingers 142 are freed to move radially inward out of engagement with groove 146. Sleeve 140 and lower spacer tube 134 are then able to move upward relative to upper spacer tube 130, to allow gun spacer assembly 128 to telescopically collapse upon itself when dropped to the bottom of the well.

Figure 4:
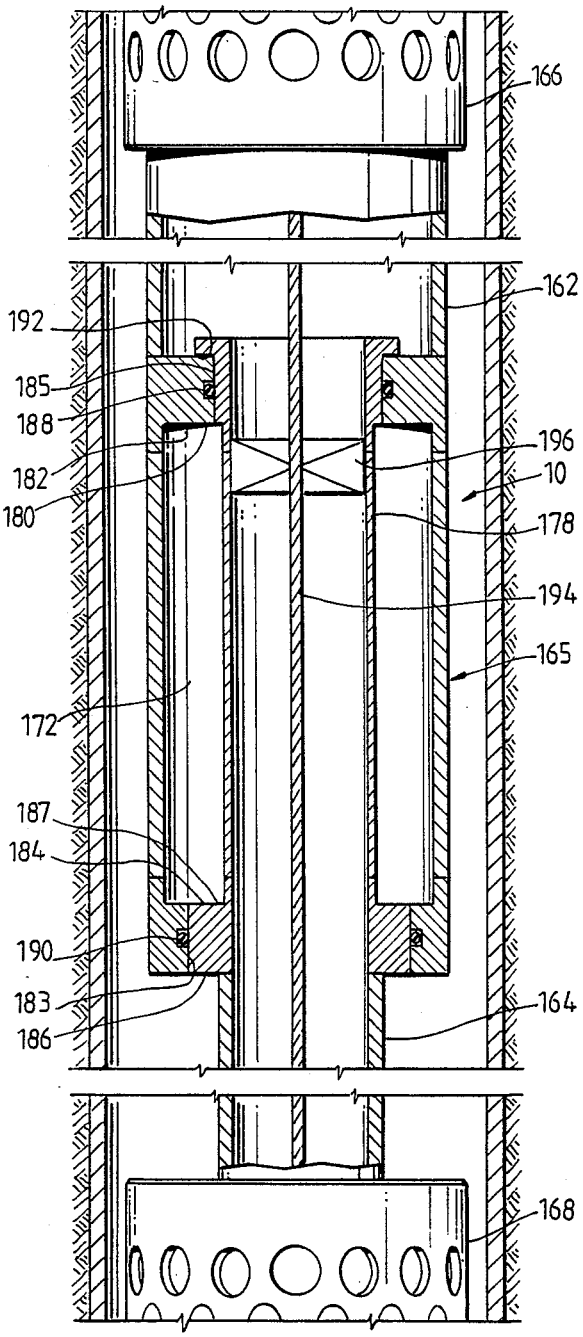
FIG. 4 is a side view, depicted partially in vertical section, of another alternative embodiment of a perforating gun assembly in accordance with the present invention, showing the hydraulic pressure locking means.

Referring now to FIG. 4, therein is shown a further alternative embodiment of the present invention. Indicated generally by reference numeral 160 is a perforating assembly in accordance with the present invention. Perforating assembly 160 includes a gun spacer assembly 165 formed by an upper spacer tube 162 and a lower spacer tube 164. Upper spacer tube 162 and lower spacer tube 164 are operatively coupled to upper perforating gun 166 and lower perforating gun 168, respectively. As seen in FIG. 4, lower spacer tube 164 has a smaller diameter than upper spacer tube 162, thereby permitting lower spacer tube 164 to telescope upward within upper spacer tube 162 in order to decrease the length of perforating assembly 160.

Upper spacer tube 162 and lower spacer tube 164, together with sealing projections 182 and 184 define an annular chamber 172. Annular chamber 172 is preferably filled with a fluid such as high viscosity oil. A seal 188 is placed between a radially inwardly extending projection 182 of upper spacer tube 162 and an O-ring seal surface 185 on lower spacer tube 164 to define the upper end 180 of chamber 172. Projection 182 may be operatively coupled to upper spacer tube 162 or may be integrally formed with upper spacer tube 162. Another O-ring seal 190 is placed between surface 183 on upper spacer tube 162 and a piston 186 coupled to lower spacer tube 164 to define the lower end 187 of fluid reservoir 172. O-ring seals 188 and 190 prevent leakage of fluid from the fluid reservoir 172. A stop ledge 192 on lower spacer tube 164 projects radially outwardly from the upper end of lower spacer tube 164. Stop ledge 192 is adapted to engage projection 182 to prevent downward movement of the lower spacer tube 164.

A detonating cord 194 extends from surface perforating gun 166 to lower perforating gun 168 through gun space assembly 160. Shaped charges 196 are positioned within gun spacer assembly proximate detonating cord 194. Shaped charges 196 may be retained in position by any suitable mechanism as known to the art. Shaped charges 196 are adapted to detonate when detonating cord 194 is activated, and are adapted to explode and rupture interior wall 178 of fluid reservoir 172. Detonating cord 194 will be coupled in a conventional manner to a similar detonating cord in one of perforating guns 166 or 168 to facilitate detonation of stopped charges 196 in response to the detonation of the perforating guns.

In operation downward movement of lower spacer tube 164 and lower perforating gun 168 is prevented by engagement of stop ledge 192 with projection 182. Upward movement of lower spacer tube 164 is prevented by the fluid in the annular chamber 172. In order to telescopically collapse the lower spacer tube within the upper spacer tube 162, it is necessary to relieve the fluid pressure within fluid reservoir 172. When perforating guns 166 and 168 are activated, detonating cord 194 detonates the shaped charges 196, which explode, rupturing lower spacer tube 164, and therefore fluid reservoir 172. Hydraulic fluid within the fluid reservoir 172 is released, relieving the fluid pressure and allowing upward movement of piston 186 into fluid reservoir 172. This upward movement allows telescopic collapse of upper spacer tube 62 and lower spacer tube 164.

While preferred embodiments have been shown and described, modifications thereof can be made by one skilled in the art without departing from the spirit and scope of the invention. Accordingly, the techniques and structures described herein are illustrative only and are not to be considered as limitations upon the scope of the present invention.

What is claimed is:

1. An apparatus for use in perforating a well through use of a perforating gun suspended from a tubing string in the well, comprising:

a carrier member adapted to be suspended from said tubing string;

a perforating gun suspended from said carrier member;

said carrier member being releasable from said tubing string after said perforating gun is fired and comprising a first spacer member, and a second spacer member movable from a first position to a second position relative to said first spacer member, said second spacer member being in said first position prior to being released from said tubing string, and being movable to said second position after said carrier member is released from said tubing string, said carrier member having a first axial length when said second spacer member is in said first position, and having a second, shorter, axial length when said second spacer member is in said second position; and means for releasably retaining said second spacer member in said first position;

said means for releasably retaining said second spacer member in said first position comprising a fluid reservoir associated with said first spacer member, said fluid reservoir containing a fluid;

a piston associated with said second spacer member, said piston adapted to move within said fluid reservoir but restrained from doing so by the pressure of said fluid within said fluid reservoir;

means for releasing said fluid from said fluid reservoir to allow movement of said piston in said fluid reservoir.

2. An apparatus for use in perforating a well through use of a perforating gun suspended from a tubing string in the well, comprising:

a first perforating gun adapted to be suspended from said tubing string and being releasable from said tubing string after said first perforating gun is fired;

a carrier member suspended from said first perforating gun; and a second perforating gun suspended from said carrier member;

said carrier member comprising a first spacer member, and a second spacer member movable from a first position to a second position relative to said first spacer member, said second spacer member being in said first position prior to said first perforating gun being released from said tubing string, and being movable to said second position after said first perforating gun is released from said tubing string, said carrier member having a first axial length when said second spacer member is in said first position, and having a second, shorter, axial length when said second spacer member is in said second position; and means for releasably retaining said second spacer member in said first position;

said means for releasably retaining said second spacer member in said first position comprising a fluid reservoir associated with said first spacer member, said fluid reservoir containing a fluid;

a piston associated with said second spacer member, said piston adapted to move within said fluid reservoir but restrained from doing so by the pressure of said fluid within said fluid reservoir;

means for releasing said fluid from said fluid reservoir to allow movement of said piston in said fluid reservoir.

3. The apparatus of claim 1 wherein said second spacer member is suspended from said first spacer member, and wherein said first and second spacer members are in generally coaxial relation to one another.

4. The apparatus of claim 1 wherein one of said first and second spacer members is slidably received inside the other of said first and second spacer members, said first and second spacer members adapted to telescopically collapse relative to one another.

5. The apparatus of claim 1 wherein said means for releasing said fluid from said fluid reservoir comprises an explosive charge adapted to rupture said fluid reservoir.

6. The apparatus of claim 2 wherein said second spacer member is suspended from said first spacer member, and wherein said first and second spacer members are in generally coaxial relation to one another.

7. The apparatus of claim 2 wherein one of said first and second spacer members is slidably received inside the other of said first and second spacer members, said first and second spacer members adapted to telescopically collapse relative to one another.

8. The apparatus of claim 2 wherein said means for releasing said fluid from said fluid reservoir comprises an explosive charge adapted to rupture said fluid reservoir.

* * * * *